US006761179B2

(12) United States Patent
Rosenbauer et al.

(10) Patent No.: US 6,761,179 B2
(45) Date of Patent: Jul. 13, 2004

(54) DEVICE FOR MONITORING THE FUNCTIONING OF A ROTATING LIQUID-DISCHARGING APPLIANCE

(75) Inventors: Michael Rosenbauer, Reimlingen (DE); Bernd Schessl, Dillingen (DE); Angelo Canova, Collegno (IT)

(73) Assignees: BSH Bosch und Siemens Hausgerate GmbH, Munich (DE); ELBI International SpA, Borgata Paradiso Collegno (IT)

( * ) Notice: Subject to any disclaimer, the term of this patent is extended or adjusted under 35 U.S.C. 154(b) by 0 days.

(21) Appl. No.: 10/100,580

(22) Filed: Mar. 18, 2002

(65) Prior Publication Data

US 2002/0185162 A1 Dec. 12, 2002

Related U.S. Application Data

(63) Continuation of application No. PCT/EP00/08809, filed on Sep. 8, 2000.

(30) Foreign Application Priority Data

Sep. 16, 1999 (IT) ..... TO99A0789

(51) Int. Cl.[7] ..... B08B 3/00; D06F 33/00

(52) U.S. Cl. ..... 134/113; 134/57 D; 68/12.02

(58) Field of Search ..... 134/56 D, 57 D, 134/58 D, 113; 68/12.02

(56) References Cited

U.S. PATENT DOCUMENTS

| | | | | |
|---|---|---|---|---|
| 5,291,626 A | * | 3/1994 | Molnar et al. | 8/158 |
| 5,446,531 A | | 8/1995 | Boyer et al. | 356/72 |
| 5,560,060 A | * | 10/1996 | Dausch et al. | 8/158 |
| 6,474,351 B1 | * | 11/2002 | Cerruti et al. | 134/99.2 |

FOREIGN PATENT DOCUMENTS

| | | |
|---|---|---|
| DE | 37 32 451 A1 | 4/1989 |
| DE | 38 35 406 A1 | 4/1990 |
| EP | 0 534 213 A1 | 3/1993 |
| EP | 0 793 939 A1 | 9/1997 |

* cited by examiner

*Primary Examiner*—Frankie L. Stinson
*Assistant Examiner*—Joseph L. Perrin
(74) *Attorney, Agent, or Firm*—Laurence A. Greenberg; Werner H. Stemer; Gregory L. Mayback

(57) ABSTRACT

A device for monitoring the functioning of a rotating liquid-discharging appliance includes at least one collecting chamber with at least one inlet orifice, at least one outlet orifice, and at least one sensor. The outlet orifice of the collecting chamber has a smaller cross section than the inlet orifice, and the sensor is a level sensor that transmits signals to an evaluation apparatus, by which an entire functioning of the rotating liquid-discharging appliance can be monitored. The monitoring device is disposed approximately in a region acted upon with liquid by the appliance to be monitored.

14 Claims, 4 Drawing Sheets

DEVICE FOR MONITORING THE FUNCTIONING OF A ROTATING LIQUID-DISCHARGING APPLIANCE

CROSS-REFERENCE TO RELATED APPLICATION

This application is a continuation of copending International Application No. PCT/EP00/08809, filed Sep. 8, 2000, which designated the United States.

BACKGROUND OF THE INVENTION

Field of the Invention

The invention lies in the field of appliances. The invention relates to a device for monitoring the functioning of a rotating liquid-discharging appliance.

Rotating liquid-discharging appliances may be, for example, lawn sprinklers or spray arms of a dishwashing machine, etc. Should there be a fault in the functioning of such an appliance, for example, should it come to a stop, decreases efficiency and results. In the case of a fault with lawn sprinklers, a limited area of the lawn to be sprinkled is sprinkled with an unnecessarily large quantity of water and the rest of the lawn area is not sprinkled at all, thus, killing off the lawn because of over watering, on one hand, and because of no watering, on the other hand. With respect to such a fault with spray arms of dishwashing machines, the batch to be cleaned may be acted upon unevenly by cleaning liquid, thus, leading to an inadequate cleaning result. However, should such a functional fault of an appliance cause no liquid to be discharged, in lawn sprinklers this, of course, also leads to the lawn being killed off because of no watering and, in the case of spray arms of dishwashing machines, leads, of course, to no cleaning result at all because the batch to be cleaned is not acted upon by cleaning liquid (the cleaning liquid carrying out essentially all of the cleaning).

German Published, Non-Prosecuted Patent Application DE-OS 37 32 451 discloses, for example, a monitoring device for the rotational movement of a spray arm of a dishwashing machine. The device checks only the rotational movement of the spray arm. It does not check the discharge of the liquid.

SUMMARY OF THE INVENTION

It is accordingly an object of the invention to provide a device for monitoring the functioning of a rotating liquid-discharging appliance that overcomes the hereinaforementioned disadvantages of the heretofore-known devices of this general type and that provides, in a simple way, a device that monitors the entire functioning of a rotating liquid-discharging appliance.

With the foregoing and other objects in view, there is provided, in accordance with the invention, a device for monitoring a functioning of a rotating liquid-discharging appliance, including at least one collection device defining a collection chamber having at least one inlet with a given cross-section, at least one outlet with a cross-section smaller than the given cross-section, and an interior fluidically connected to the inlet and to the outlet. The monitoring device having at least one level sensor fluidically connected to the interior and being disposed approximately in a region acted upon with liquid by the appliance to be monitored. The level sensor produces a signal to be evaluated by an evaluation device.

In the event of the fault-free rotation of the liquid-discharge appliance and in the event of the fault-free discharge of liquid, in the device according to the invention, the collecting chamber is filled with the liquid through the inlet orifice and is emptied again through the outlet orifice so that the sensor detects a constantly fluctuating filling level in the collecting chamber. The evaluation apparatus can interpret the fluctuation in a simple way as the satisfactory functioning of the liquid-discharging appliance. Should rotation and/or the discharge of liquid not take place, whether the collecting chamber is acted upon or not, the sensor does not detect a constantly fluctuating filling level in the collecting chamber, which is then interpreted by the evaluation apparatus in a simple way as a functional fault of the liquid-discharging appliance. When the collecting chamber is not acted upon with liquid, for example, when the appliance to be monitored is at a standstill or in the absence of the discharge of liquid, the sensor detects a constantly empty collecting chamber. However, should the collecting chamber be acted upon constantly with liquid, with the appliance to be monitored being at a standstill, the sensor detects a constantly fully filled collecting chamber. At all events, in both instances, no constantly fluctuating filling level is measured, so that the evaluation apparatus detects in a simple way a functional fault of the liquid-discharging appliance. The invention provides in a simple way a device by which the entire functioning of a rotating liquid-discharging appliance can be monitored.

In accordance with another feature of the invention, the cross-section of the inlet orifice and of the outlet orifice and also the volume of the collecting chamber are dimensioned such that, under normal functioning conditions of the appliance to be monitored, the liquid level in the collecting chamber oscillates periodically about a predetermined reference level. By such a measure, the device according to the invention becomes even more functionally reliable because a periodically oscillating liquid level can be evaluated even more easily.

In accordance with a further feature of the invention, the level sensor is an optical sensor, thus, achieving a simplification in the detection of the level in the collecting chamber.

In accordance with an added feature of the invention, the sensor part of the optical sensor is a V-angle shape of a substantially transparent vertical wall of the collecting chamber, the V-angle shape projecting with the vertex into the interior wall of the collecting chamber. When these optical sensors, normally referred to as immersion rods with light refraction, are used for liquid-level measurement, the device according to the invention becomes even more functionally reliable.

In accordance with an additional feature of the invention, the sensor part is the V-shaped portion of the vertical wall.

In accordance with yet another feature of the invention, the inlet is fluidically connected to the region acted upon with liquid.

With the objects of the invention in view, in a dishwashing machine having an evaluation device and at least one rotating spray arm spraying washing liquid at least at a region in the machine, there is also provided a device for monitoring a functioning of the spray arm including at least one collection device defining a collection chamber having at least one inlet with a given cross-section, at least one outlet with a cross-section smaller than the given cross-section, and an interior fluidically connected to the inlet and to the outlet, having at least one level sensor fluidically connected to the interior, the level sensor producing a signal evaluated by the evaluation device, and being disposed approximately at the region in the machine.

In accordance with yet a further feature of the invention, the device is disposed in a dishwashing machine for monitoring the functioning of at least one rotating spray arm spraying washing liquid, with the result that the reliable cleaning action of the dishwashing machine is ensured in a simple way.

In accordance with yet an added feature of the invention, advantageously, the device is disposed in a side wall of the dishwashing machine, thus, achieving a simplification in the installation of the device according to the invention.

In accordance with yet an additional feature of the invention, the device is disposed in a door of the dishwashing machine. The largest possible variety of assemblies is normally installed in the door of the dishwashing machine, so that the installation of a further assembly does not signify any particularly high outlay.

In accordance with again another feature of the invention, the device is disposed in a cleaning-agent dispensing unit. By being installed in an assembly that is already present in a dishwashing machine, it is possible for the device according to the invention to be installed in the dishwashing machine without any further outlay.

In accordance with again a further feature of the invention, in the event of a fault, the signals from the level sensor lead, through the evaluation apparatus, to a change in the control and/or to the interruption of a program cycle and/or to the activation of an optical and/or acoustic warning signal, with the result that impairments of a cleaning result due to the malfunctioning of the spray arm can be avoided as far as possible.

With the objects of the invention in view, in an appliance having an evaluation device and a rotating liquid-discharging device spraying washing liquid at least at a region in the appliance, there is also provided a device for monitoring a functioning of the rotating liquid-discharging device including at least one collection device defining a collection chamber having at least one inlet with a given cross-section, at least one outlet with a cross-section smaller than the given cross-section, and an interior fluidically connected to the inlet and to the outlet, having at least one level sensor fluidically connected to the interior, the level sensor producing a signal evaluated by the evaluation device, and being disposed approximately at the region in the appliance.

With the objects of the invention in view, in combination with an appliance having an evaluation device and a rotating liquid-discharging device spraying washing liquid at least at a region in the appliance, there is also provided a device for monitoring a functioning of the rotating liquid-discharging device, the monitoring device including at least one collection device defining a collection chamber having at least one inlet with a given cross-section, at least one outlet with a cross-section smaller than the given cross-section, and an interior fluidically connected to the inlet and to the outlet, having at least one level sensor fluidically connected to the interior, the level sensor producing a signal evaluated by the evaluation device, and being disposed approximately at the region in the appliance.

Other features that are considered as characteristic for the invention are set forth in the appended claims.

Although the invention is illustrated and described herein as embodied in a device for monitoring the functioning of a rotating liquid-discharging appliance, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
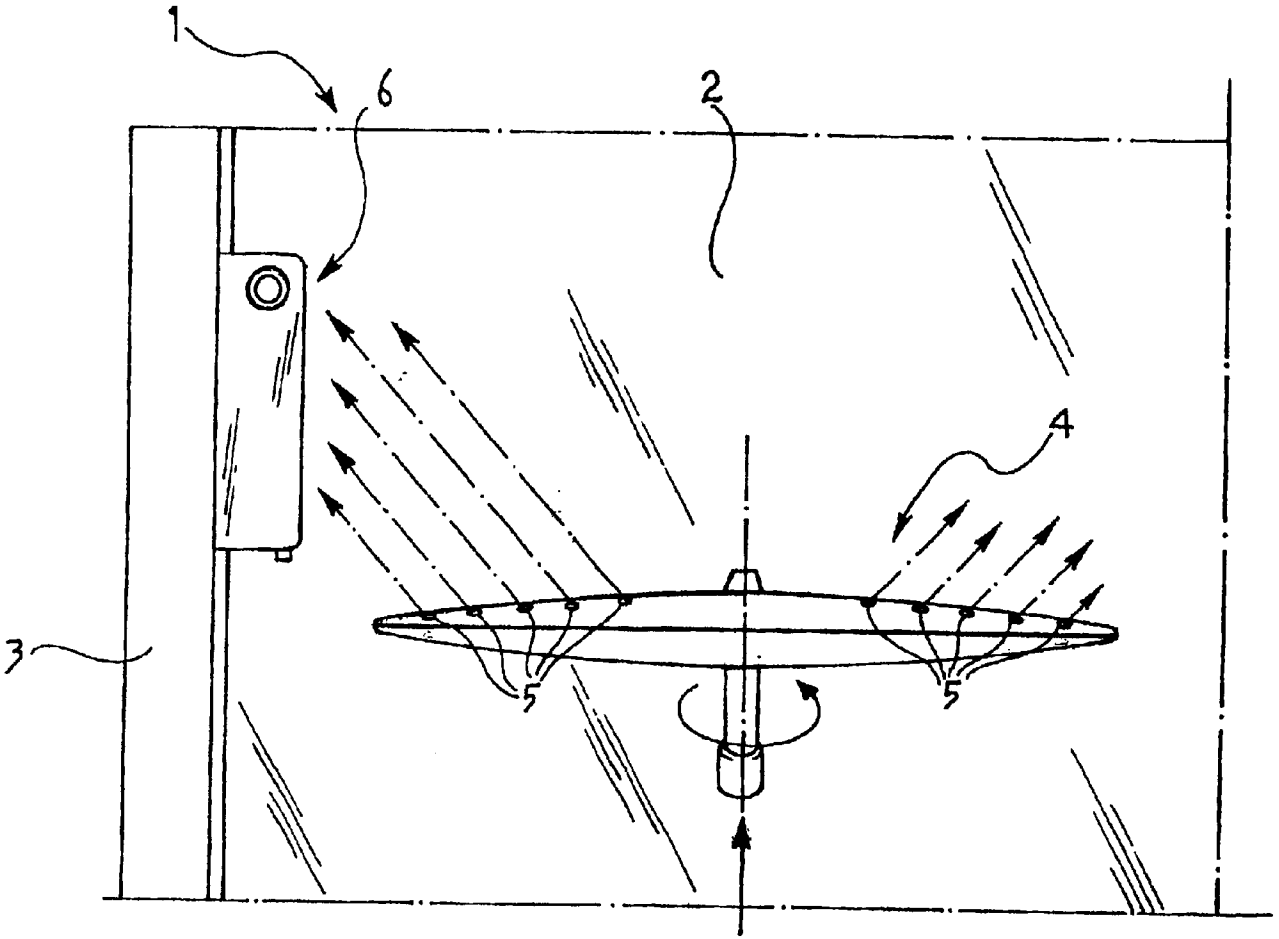
FIG. 1 is a fragmentary elevational view of a dishwashing machine equipped with a monitoring device according to the invention.

Referring now to the figures of the drawings in detail and first, particularly to FIG. 1 thereof, there is shown a device according to the invention for monitoring the functioning of a rotating liquid-discharging appliance 4 installed in a dishwashing machine 1, not described in any more detail, and that has a washing container 2 capable of being closed by a door 3. As a result, a reliable cleaning action of the dishwashing machine 1 is ensured in a simple way.

Located in the washing container 2 is at least one spray arm 4—the rotating liquid-discharging appliance—which is equipped with a plurality of spray nozzles 5 and the functioning of which is to be monitored by the device according to the invention. Conventionally, the spray arm 4 is connected to a non-illustrated circulating pump that delivers washing liquid extracted from a non-illustrated collecting basin located at the bottom of the washing container 2.

On a side directed into the interior of the washing container 2, the door 3 of the dishwashing machine 1 carries a cleaning-agent dispensing unit 6 for washing agents, such as cleaning agents and rinsing agents.

The cleaning-agent dispensing unit 6 is disposed in the region acted upon with liquid by the appliance to be monitored—the spray arm 4—and is struck periodically by the washing liquid discharged by the spray arm 4.

Figure 2:
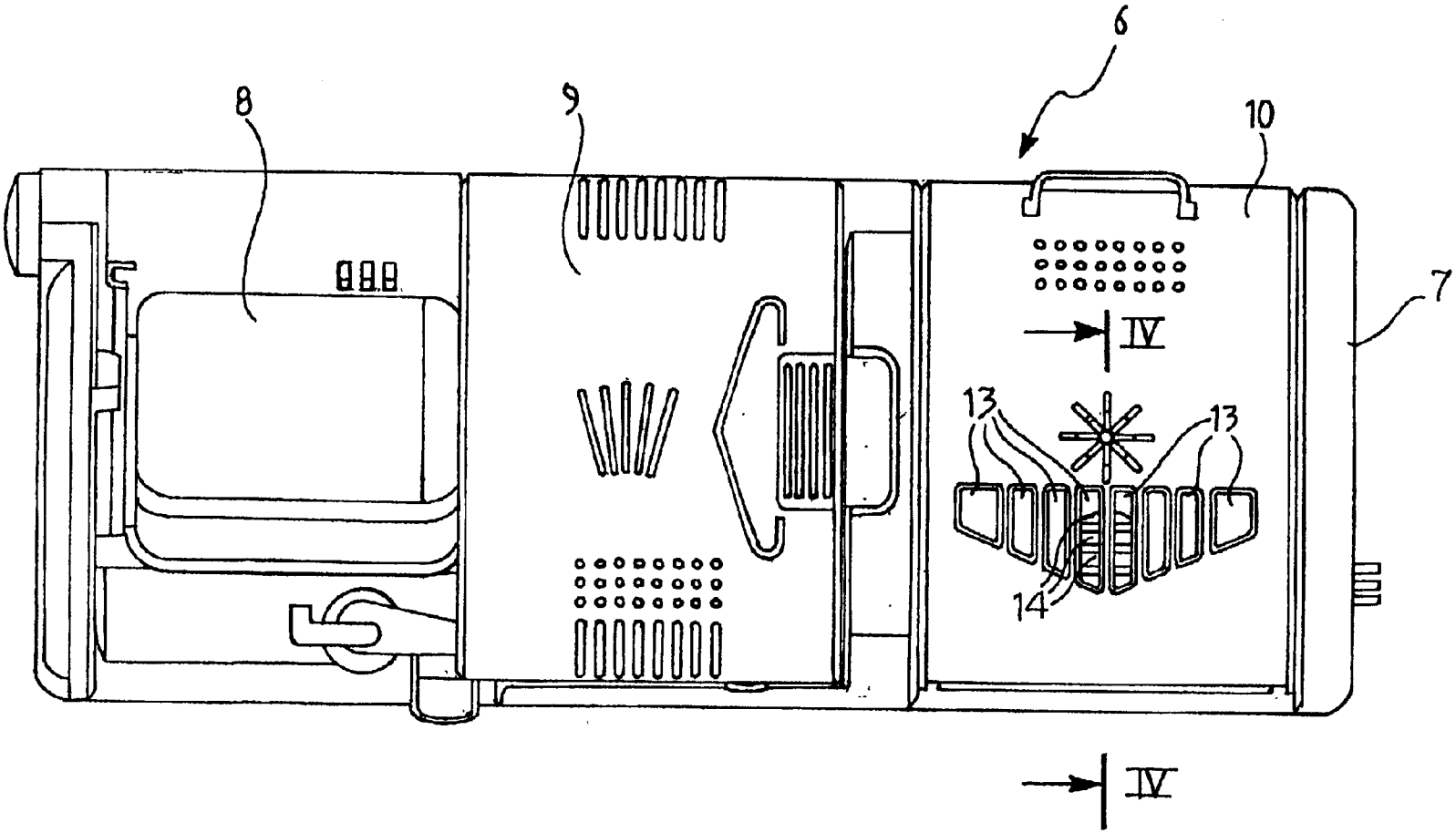
FIG. 2 is a front elevational view of a cleaning-agent dispensing unit for a dishwashing machine with the monitoring device according to the invention integrated therein.
Figure 3:
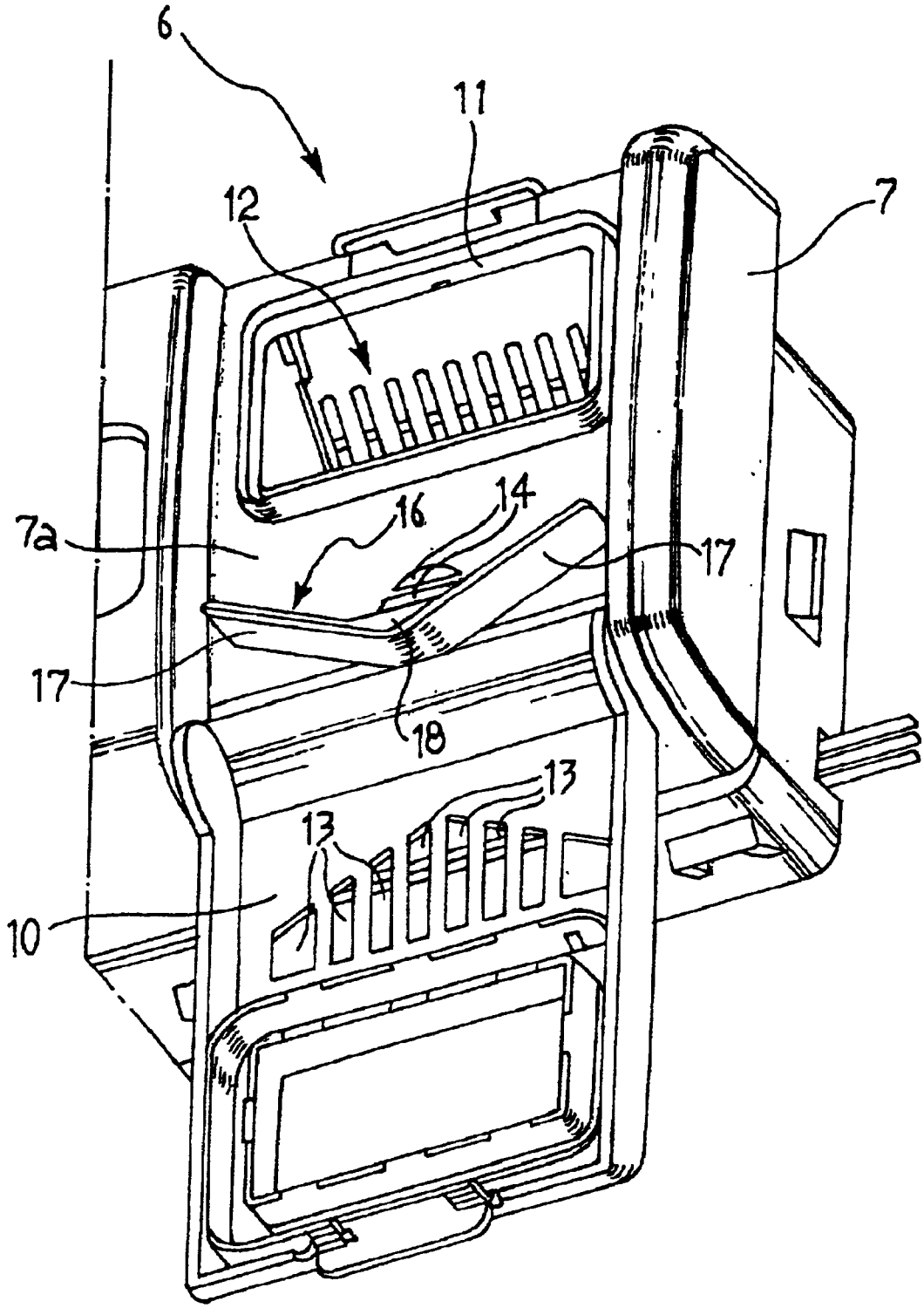
FIG. 3 is a fragmentary, perspective view of part of the cleaning-agent dispensing unit of FIG. 2.

As can be seen more clearly in FIGS. 2 and 3, the cleaning-agent dispensing unit 6 has an upper part 7, at one end of which is located a cleaning-agent receptacle 8 that is intended for receiving a dose of cleaning agent and that, in the exemplary embodiment, can be closed by a sliding lid 9. In the exemplary embodiment illustrated, furthermore, a hinged lid 10 for closing an orifice 11 of a container 12 intended for receiving a specific quantity of rinse agent is attached to the upper part 7 of the cleaning-agent dispensing unit 6 at the other end of the upper part 7.

In the exemplary embodiment described, the device according to the invention is disposed in the cleaning-agent dispensing unit 6. By being installed in an assembly that is present in any case in a dishwashing machine 1, it is possible for the device according to the invention to be installed in the dishwashing machine 1 without any further outlay.

The hinged lid 10 is provided with a plurality of substantially vertical and parallel orifices 13. When the hinged lid 10 is closed, orifices 13 point in the direction of a front wall 7*a* of the upper part of the cleaning-agent dispensing unit 6, in which front wall are disposed a number of substantially horizontal inlet orifices 14 of the device according to the invention.

As is evident in FIGS. 3 and 4, there extends on the front wall 7*a* of the upper part 7 of the cleaning-agent dispensing unit 6, and also laterally and below the inlet orifices 14, a collecting point 16 formed by a pair of lateral and inclined ribs 17 that converge and are connected to one another below the inlet orifices 14. At the collecting point 16 thus formed by the ribs 17 extends a vertical plate 18 that is elevated in relation to the plane of the front wall 7*a*.

Figure 4:
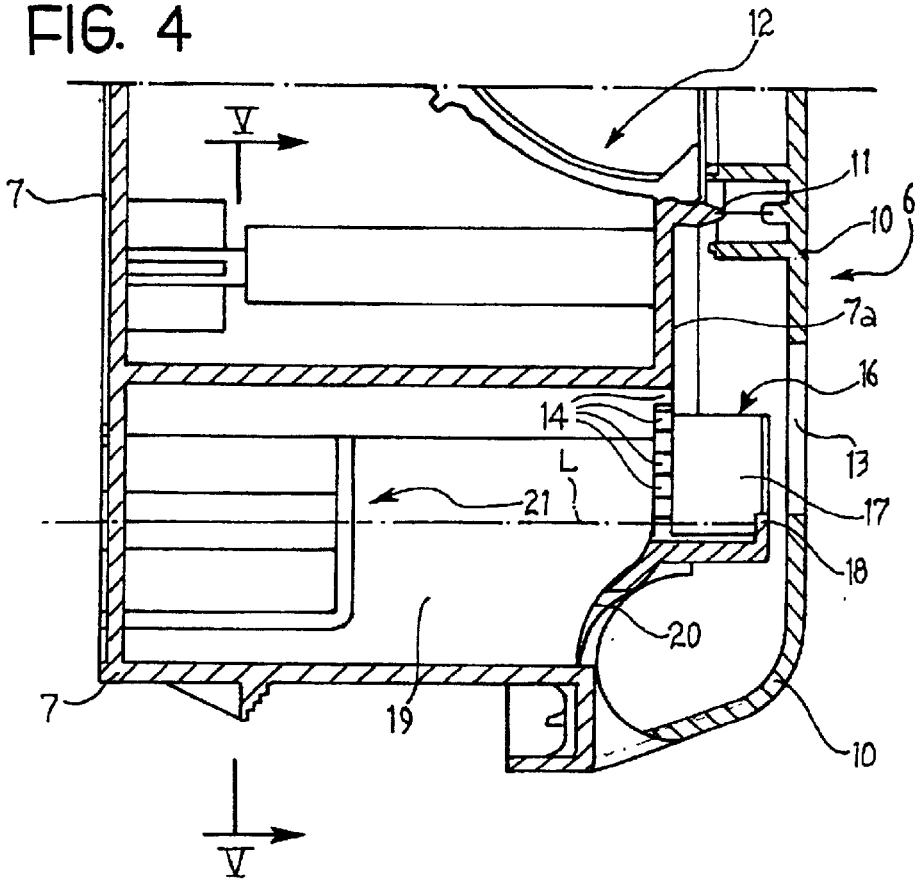
FIG. 4 is a fragmentary, cross-sectional view through the cleaning-agent dispensing unit of FIG. 2 along line IV—IV.
Figure 5:
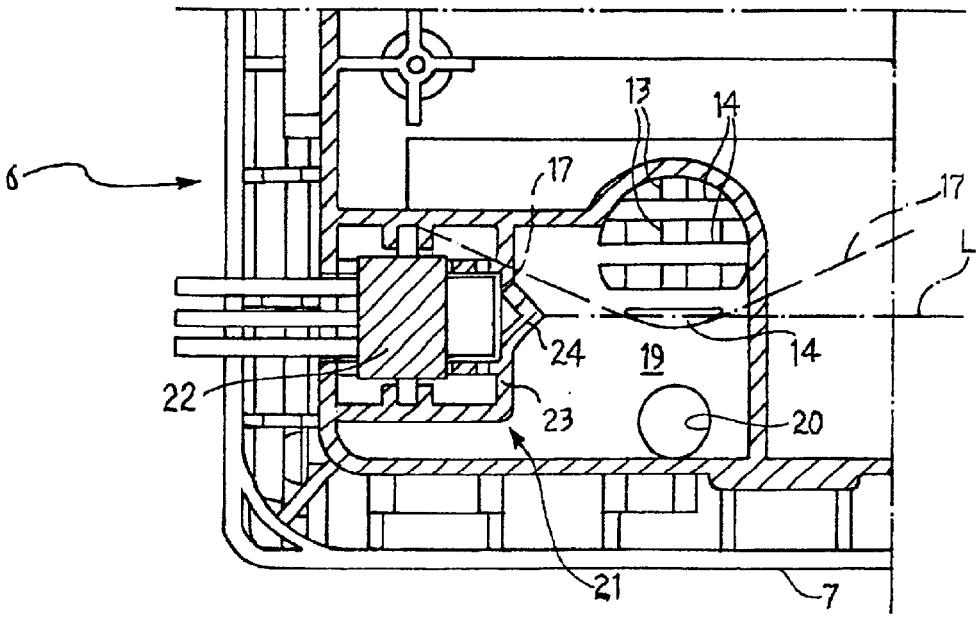
FIG. 5 is a fragmentary, cross-sectional view through the cleaning-agent dispensing unit of FIG. 4 along line V—V.

As can best be seen in FIGS. 4 and 5, a collecting chamber 19 of the device according to the invention is disposed, behind the front wall 7*a*, in the interior of the upper part 7 of the cleaning-agent dispensing unit 6 and is provided in the lower region with a reduced outlet orifice indicated by 20. The inlet orifices 14 formed in the front wall 7*a* of the upper part 7 are directed onto the upper part of the collecting chamber 19 (see FIGS. 4 and 5).

Disposed in the collecting chamber 19 is a sensor 21, configured as a level sensor, which transmits signals to a non-illustrated evaluation apparatus. In the exemplary embodiment shown, the sensor is an optical sensor, an electrical level sensor 21 being used, which can be seen, complete, in FIGS. 4 and 5 and contains a feed 22 (FIG. 5) with a pair of diodes, one diode acting as a transmitter for emitting optical radiation and the other as a receiver. Both diodes are directed toward the substantially transparent vertical wall 23 of the collecting chamber 19. In the wall 23, a sensor part of the optical sensor 21 is formed as a V-angle shape 24 that serves as a prism for the possible refraction of the optical radiation and projects with the vertex into the interior of the collecting chamber 19.

The feed 22 is connected to the non-illustrated evaluation apparatus, for example, in a program controller, not described in any more detail, of the dishwashing machine 1.

When the dishwashing machine 1 is in operation, part of the washing liquid discharged by the rotating spray arm 4 impinges periodically on the cleaning-agent dispensing unit 6 and passes through the orifices 13 of the hinged lid 10 into the collecting point 16 and from there the quantity of washing liquid extracted by the collecting point 16 passes into the device according to the invention, specifically, through the inlet orifices 14 into the collecting chamber 19.

The outlet orifice 20 of the device according to the invention has a smaller cross-section than the inlet orifice 14. Specifically, the cross section of the inlet orifice 14 and of the outlet orifice 20 and also the volume of the collecting chamber 19 are dimensioned such that, under the normal functioning conditions of the spray arm 4, the liquid level in the collecting chamber 19 oscillates periodically about a predetermined reference level.

The sensor 21 delivers an electrical signal relating to the development in time of the liquid level in the collecting chamber 19.

Under normal functional conditions, the signal delivered by the sensor 21 oscillates periodically in exactly the same way as the liquid level in the collecting chamber 19 oscillates.

If the spray arm 4 is jammed during the operation of the dishwashing machine 1, for example, as a result of the movement and/or displacement of objects inside the machine 1, i.e., crockery, the signal 21 delivered by the level sensor ceases to oscillate. Particularly when the arm stops in a position in which it constantly sprays washing agent in the direction of the collecting chamber 19, the collecting chamber 19 remains constantly filled up to the level L that coincides with the overflow level defined by the upper edge of the plate 18 at the collecting point 16.

However, if the spray arm 4 remains at a standstill in a position in which the discharged liquid jets no longer strike the hinged lid 10 of the cleaning-agent dispensing unit 6 and/or if the discharge of washing liquid does not take place, the collecting chamber 19 is emptied through the outflow orifice 20.

In both situations referred to above, the jamming conditions of the spray arm can be detected by the basic signal delivered by the level sensor 21. In the exemplary embodiment shown, these signals from the level sensor 21 lead in the event of a fault, in the program controller connected to the evaluation apparatus, to a change in the control and/or to the interruption of a program cycle and/or to the activation of an optical and/or acoustic warning signal.

The device for monitoring the functioning of a rotating liquid-discharging appliance—the spray arm 4 of the dishwashing machine 1—may, of course, also be disposed on another side wall of the dishwashing machine 1 or at another point in the washing container 2 of the dishwashing machine 1 in the region acted upon by liquid. Furthermore, other level sensors, instead of the one described herein, may, of course, also be used.

The invention provides, in a simple way, a device by which the entire functioning of a rotating liquid-discharging appliance can be monitored.

We claim:

1. A device for monitoring a functioning of a rotating liquid-discharging appliance, comprising:

at least one collection device defining a collection chamber having:

at least one inlet with a given cross-section;

at least one outlet disposed vertically below said at least one inlet, said at least one outlet having a cross-section smaller than said given cross-section; and an interior fluidically connected to said inlet and to said outlet for allowing a gravitational liquid flow;

having at least one level sensor fluidically connected to said interior, said level sensor producing a signal to be evaluated by an evaluation device; and being disposed approximately in a region acted upon with liquid by the appliance to be monitored.

2. The device according to claim 1, wherein:

said collection chamber has a volume; and said given cross-section, said cross-section of said outlet, and said volume are dimensioned to have a liquid level in said collecting chamber periodically oscillate about a predetermined reference level under normal functional conditions of the appliance to be monitored.

3. The device according to claim 1, wherein said level sensor is an optical sensor.

4. The device according to claim 3, wherein:

said collection chamber has a substantially transparent vertical wall with a V-shaped portion;

said optical sensor has a V-shaped sensor part connected to said V-shaped portion of said vertical wall; and a vertex of said sensor part projects into said interior of said collection chamber.

5. The device according to claim 4, wherein said sensor part is said V-shaped portion of said vertical wall.

6. The device according to claim 1, wherein said inlet is fluidically connected to the region acted upon with liquid.

7. In a dishwashing machine having an evaluation device and at least one rotating spray arm spraying washing liquid at least at a region in the machine, a device for monitoring a functioning of the spray arm, comprising:

at least one collection device defining a collection chamber having:

at least one inlet with a given cross-section;

at least one outlet with a cross-section smaller than said given cross-section; and an interior fluidically connected to said inlet and to said outlet;

having at least one level sensor fluidically connected to said interior, said level sensor producing a signal evaluated by the evaluation device; and being disposed approximately at the region in the machine for receiving the washing liquid sprayed from the at least one rotating spray arm.

8. The device according to claim 7, wherein:

the dishwashing machine has a side wall; and said collection device is disposed at the side wall.

9. The device according to claim 7, wherein:

the dishwashing machine has a door; and said collection device is disposed at the door.

10. The device according to claim 7, wherein:

the dishwashing machine has a cleaning-agent dispensing unit; and said collection device is disposed in the cleaning-agent dispensing unit.

11. The device according to claim 7, wherein said level sensor includes means for causing the evaluation device, in the event of a fault, to at least one of:

change a control of the machine;

interrupt a program of the machine;

activate an optical warning signal; and activate an acoustic warning signal with the signal produced by said level sensor.

12. The device according to claim 7, wherein said inlet is fluidically connected to the region in the machine.

13. In an appliance having an evaluation device and a rotating liquid-discharging device disposed in a washing container and spraying washing liquid at least at a region in the appliance, a device for monitoring a functioning of the rotating liquid-discharging device, comprising:

at least one collection device mounted in the washing container defining a collection chamber having:

at least one inlet with a given cross-section;

at least one outlet with a cross-section smaller than said given cross-section; and an interior fluidically connected to said inlet and to said outlet;

having at least one level sensor fluidically connected to said interior, said level sensor producing a signal evaluated by the evaluation device; and being disposed approximately at the region in the appliance.

14. In combination with an appliance having an evaluation device and a rotating liquid-discharging device spraying washing liquid at least at a region in the appliance, a device for monitoring a functioning of the rotating liquid-discharging device, the monitoring device comprising:

at least one collection device defining a collection chamber having:

at least one inlet with a given cross-section;

at least one outlet disposed vertically below said at least one inlet, said at least one outlet having a cross-section smaller than said given cross-section; and an interior fluidically connected to said inlet and to said outlet for allowing a gravitational liquid flow;

having at least one level sensor fluidically connected to said interior, said level sensor producing a signal evaluated by the evaluation device; and being disposed approximately at the region in the appliance.

* * * * *